US006963039B1

(12) United States Patent
Weng et al.

(10) Patent No.: US 6,963,039 B1
(45) Date of Patent: Nov. 8, 2005

(54) BUTTON KNOB WATERPROOFING DESIGN

(75) Inventors: Shih-Hsiung Weng, Taipei (TW); Khoon-Guan Tee, Penang (MY)

(73) Assignee: Inventec Multimedia & Telecom Corporation, Taipei (TW)

( * ) Notice: Subject to any disclaimer, the term of this patent is extended or adjusted under 35 U.S.C. 154(b) by 0 days.

(21) Appl. No.: 11/018,244

(22) Filed: Dec. 22, 2004

(51) Int. Cl.[7] ..... H01H 9/04
(52) U.S. Cl. ..... 200/302.1; 200/302.3; 200/5 R; 200/339
(58) Field of Search ..... 200/302.1, 302.2, 200/17 R, 5 R, 553, 302.3, 339

(56) References Cited

U.S. PATENT DOCUMENTS 5,086,200 A * 2/1992 Kline et al. ..... 200/571
5,471,022 A * 11/1995 Kiss et al. ..... 200/83 B
5,514,843 A 5/1996 Wilfong et al.
5,821,482 A * 10/1998 Ootani et al. ..... 200/5 A
6,239,391 B1 * 5/2001 Nishijima et al. ..... 200/5 A
6,626,473 B1 * 9/2003 Klein et al. ..... 292/347

* cited by examiner

*Primary Examiner*—Richard K. Lee
(74) *Attorney, Agent, or Firm*—Rabin & Berdo, P.C.

(57) ABSTRACT

A waterproof button knob includes an elastic button seat with a housing trough mating with a button port of a case. The button seat isolates the interior and the exterior of the case to achieve waterproofing. The housing trough has a plurality of apertures on the bottom. The housing trough holds a button cap that has a plurality of button stems extended downwards to pass through the apertures and form a tight coupling. The button stems may be moved to hit switches located in the case.

15 Claims, 4 Drawing Sheets

BUTTON KNOB WATERPROOFING DESIGN

FIELD OF THE INVENTION

The invention relates to a button cap and a button knob structure, and particularly to a button knob waterproofing design that has a button cap and a button seat mating and coupling closely to provide waterproofing.

BACKGROUND OF THE INVENTION

Electronic devices are greatly damaged by short circuits in the internal circuitry. Hence the casing of the electronic device provides important sealing and shielding functions to protect the internal circuit and prevent dust, moisture or external elements from directly reaching the interior. This also improves the adaptability of the device to varying operational environments, which is especially important for portable devices that are very popular these days. Waterproof and dust-proof functions have become an important design issue. In general, to provide waterproofing is more difficult since water is a fluid and can infiltrate through very small gaps and slits. Once waterproofing is achieved, the problem of fending off other external materials may also be resolved.

In the design of the casing for waterproofing, as the interface of the casing generally does not have relative movement during operation, the interface is usually coupled with washers to create forced packing to repel water. However, waterproofing for the button knob structure on the case surface is more difficult to accomplish. In order to allow the button knob to function as desired, a gap must be provided between the button cap and the case to facilitate movement of the button cap, and water tends to seep in through the gap.

To remedy this problem, numerous waterproofing designs for button knob have been proposed in the prior art. For instance, U.S. Pat. No. 5,514,843 discloses a pressure-compensated key switch that places a key cap and a switch inside a case. The key cap is extended through a key hole and exposed to receive depression. To prevent water from seeping into the case through the gap between the key hole and the key cap, an elastic membrane is deployed to cover the key hole. However, the elastic membrane directly receives compression during operation. When used for a period of time, or when hit and rubbed by external forces, the membrane is easily damaged and the waterproofing function becomes ineffective. Hence its applicability is limited. Although it can provide some waterproofing, it cannot be adapted to suit many different operation environments.

SUMMARY OF THE INVENTION

In view of the aforesaid problems, the primary object of the invention is to provide a button knob waterproofing design to improve the durability of the waterproofing and prevent failure of waterproofing caused by damage resulting from operation, external impact or abrasion.

In order to achieve the foregoing object, the button knob waterproofing design according to the invention includes a button cap with a plurality of button stems extending downwards, a button seat made from an elastic material having a top surface and a bottom surface, a base board to hold the bottom surface of the button seat, and a case of an electronic device to encase the base board. The top surface of the button seat has an indented housing trough to hold the button cap. The housing trough has a plurality of apertures on the bottom mating with the button stems, and allows the button stems to pass through and extend downwards to form a tight coupling with the button cap and the button seat. The base board has a plurality of switches mating with the button stems and hit by the button stems. The case has a button port to expose the button cap to be depressed by users. The top surface of the button seat is in close contact with an inner wall surface of the case. The housing trough has an opening directing upwards corresponding to the button port to isolate the interior and the exterior of the case.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
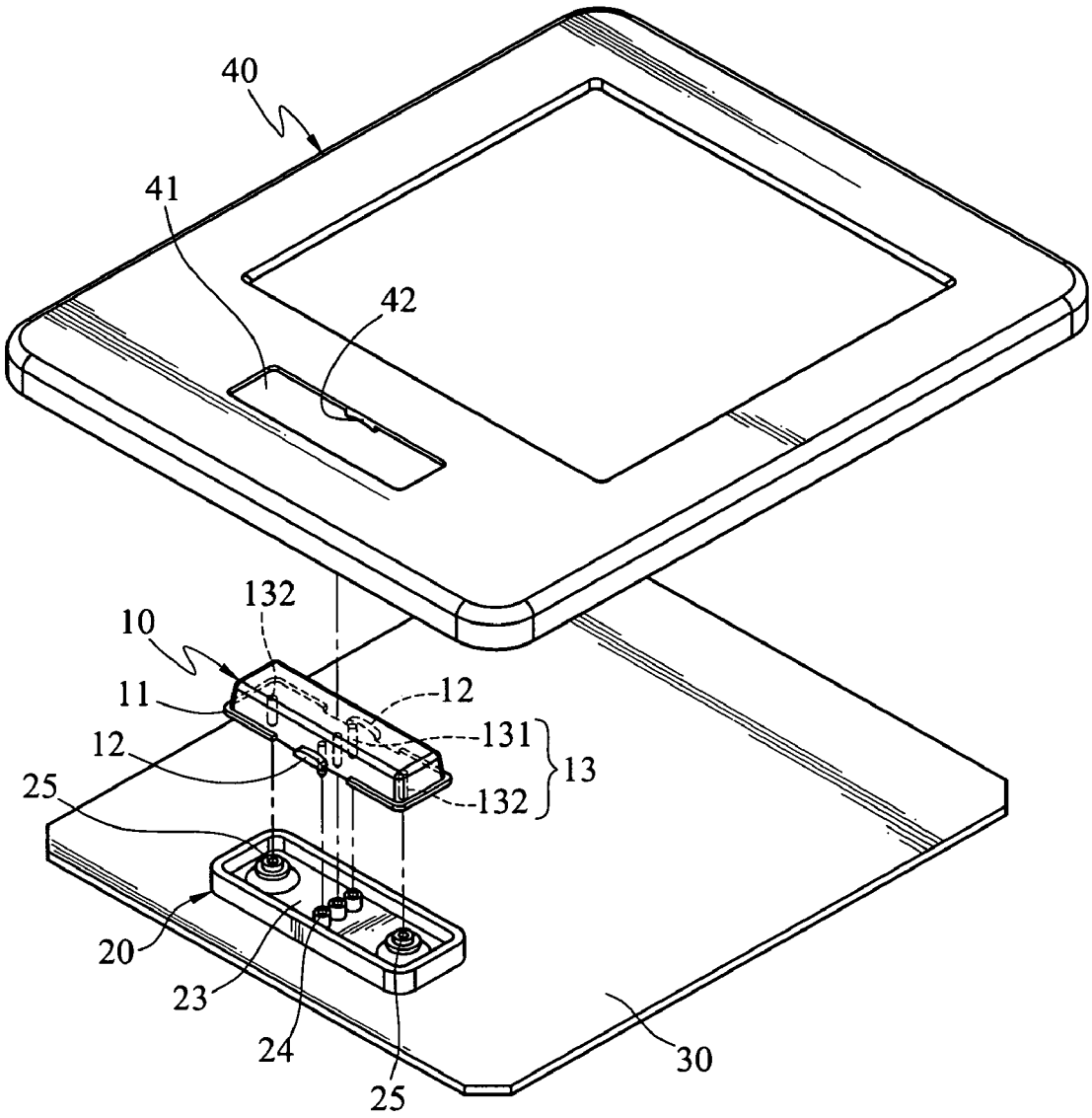
FIG. 1 is an exploded view of a first embodiment of the invention.
Figure 2:
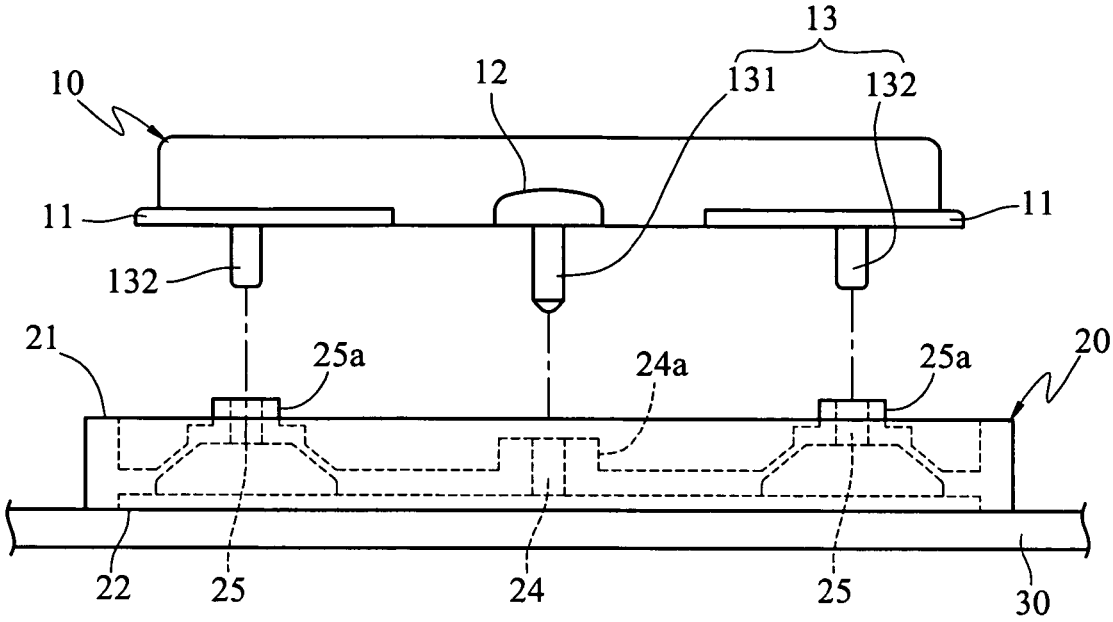
FIG. 2 is a fragmentary side view of the invention showing the button cap, button seat and base board according to FIG. 1.

Refer to FIGS. 1 through 5 for a first embodiment of the invention. The button knob waterproofing design according to the invention includes:

A button cap 10 which is a rectangular box with an opening directing downwards. The button cap 10 has a flange 11 extended horizontally from the bottom edge of an outer wall, two bosses 12 on two long sides that correspond to each other, and a plurality of button stems 13 extending downwards through the opening. The button stems 13 include a first button stem 131 in the center and two second button stems 132 on two ends of the button cap 13. The first button stem 131 is longer than the second button stems 132.

A button seat 20 made from an elastic material such as rubber. It has a top surface 21 and a bottom surface 22. The top surface 21 has a housing trough 23 to hold the button cap 10. The housing trough 23 has a plurality of apertures including a first aperture 24 and two second apertures 25 on the bottom mating with the button stems and allowing the first and second button stems 131 and 132 to pass through downwards and couple tightly with the button cap 10 and button seat 20. The apertures 24 and 25 are surrounded respectively by extensions 24*a* and 25*a* that are extended axially upwards the length of the apertures 24 and 25 to increase the contact surface between the button stems 131 and 132 and the apertures 24 and 25 and prevent water from seeping in through the gap formed therebetween. The bottom surface 22 has an indented housing space 26 facing downwards and the bottom of the housing trough 23 forms an elastic membrane 27. The membrane around the second apertures 25 domes upwards substantially to increase space for deformation on the lower side.

A base board 30 to hold the bottom surface 22 of the button seat 20 having a plurality of switches 31 mating with the second button stems 132 to receive depression of the second button stems 132. The first button stem 131 rams the base board 30 to function as a fulcrum and allow the button cap 10 to rock and drive the second button stems 132 to move upwards and downwards.

And a case 40 of an electronic device to encase the base board 30. The electronic device may be a PDA or other portable multimedia player, or a household or office electronic device. The case 40 has a button port 41. The top surface 21 of the button seat 20 makes close contact with an inner wall of the case 40 with the upward opening of the housing trough 23 corresponding to the button port 41 to expose the button cap 10 and isolate the interior and the exterior of the case 40. The flange 11 of the button cap 10 prevents the button cap 10 from escaping through the button port 41. The case 40 has two holding docks 42 on the inner side abutting the button port 41 to mate with the bosses 12 and press the button cap 10 so that the first button stem 131 can reach the base board 30 as desired.

Figure 3:
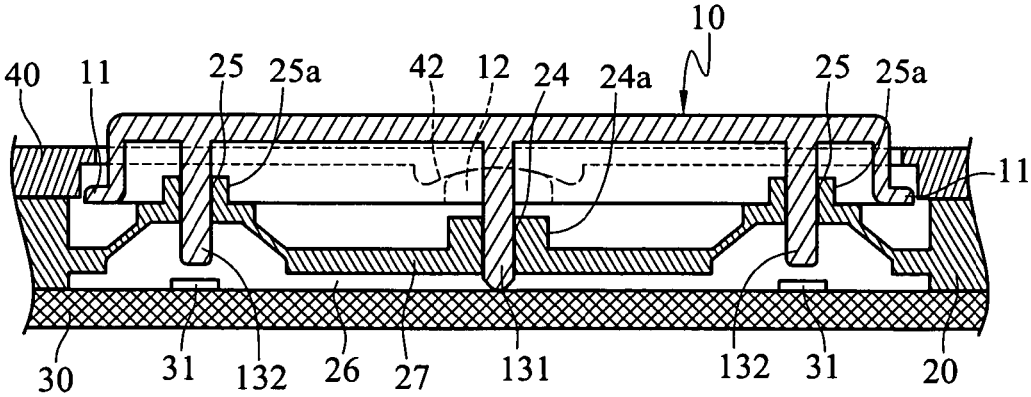
FIG. 3 is a fragmentary sectional view of the first embodiment.
Figure 4:
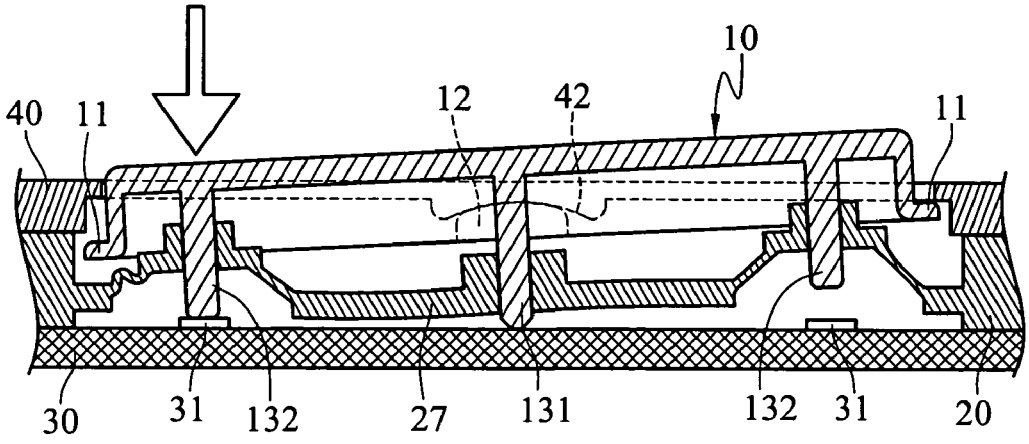
FIG. 4 is a schematic view of the invention in use according to FIG. 3.
Figure 5:
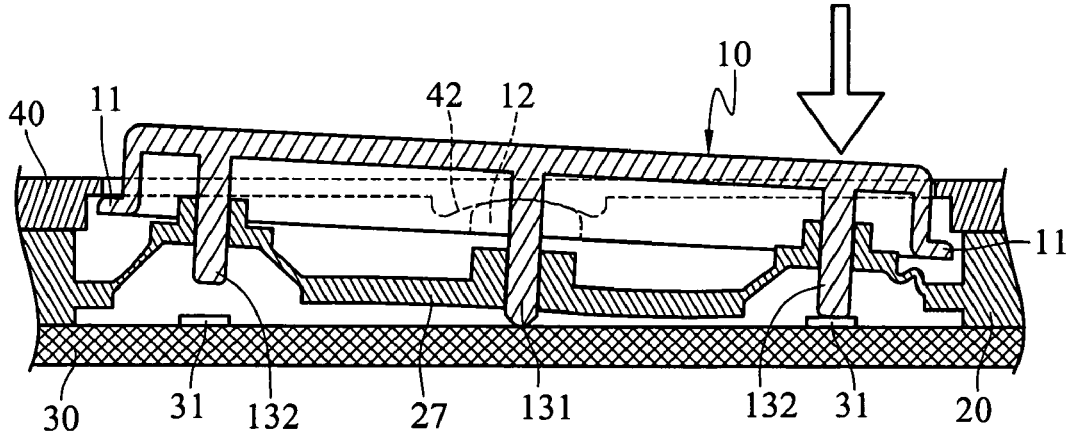
FIG. 5 is another schematic view of the invention in use according to FIG. 3.

Please refer to FIG. 3. By means of the construction set forth above, the inner peripheral edge of the case 40 around the button port 41 is blocked by the button seat 20 so that water cannot seep into the case 40 through the button port 41. When any end of the long side of the button cap 10 is depressed, the second button stem 132 is moved downwards to hit the switch 31. When the external depression force is released, the elastic membrane 27 of the housing trough 23 bounces back by the elastic force to drive the second button stem 132 upwards to stop the depression. According to the invention, a single button cap can hit two switches as shown in FIGS. 4 and 5. When the button cap 10 is depressed on the left side, because of the bracing of the first button stem 131, the button cap 10 tilts to the left and the second button stem 132 on the left side moves downwards while the second button stem 132 on the right side moves upwards without hitting the switch 31 on the right side, and vice versa. When depressing the button cap 10 on the right side, only the second button stem 132 on the right side functions to hit the switch 31 on the right side.

Figure 6:
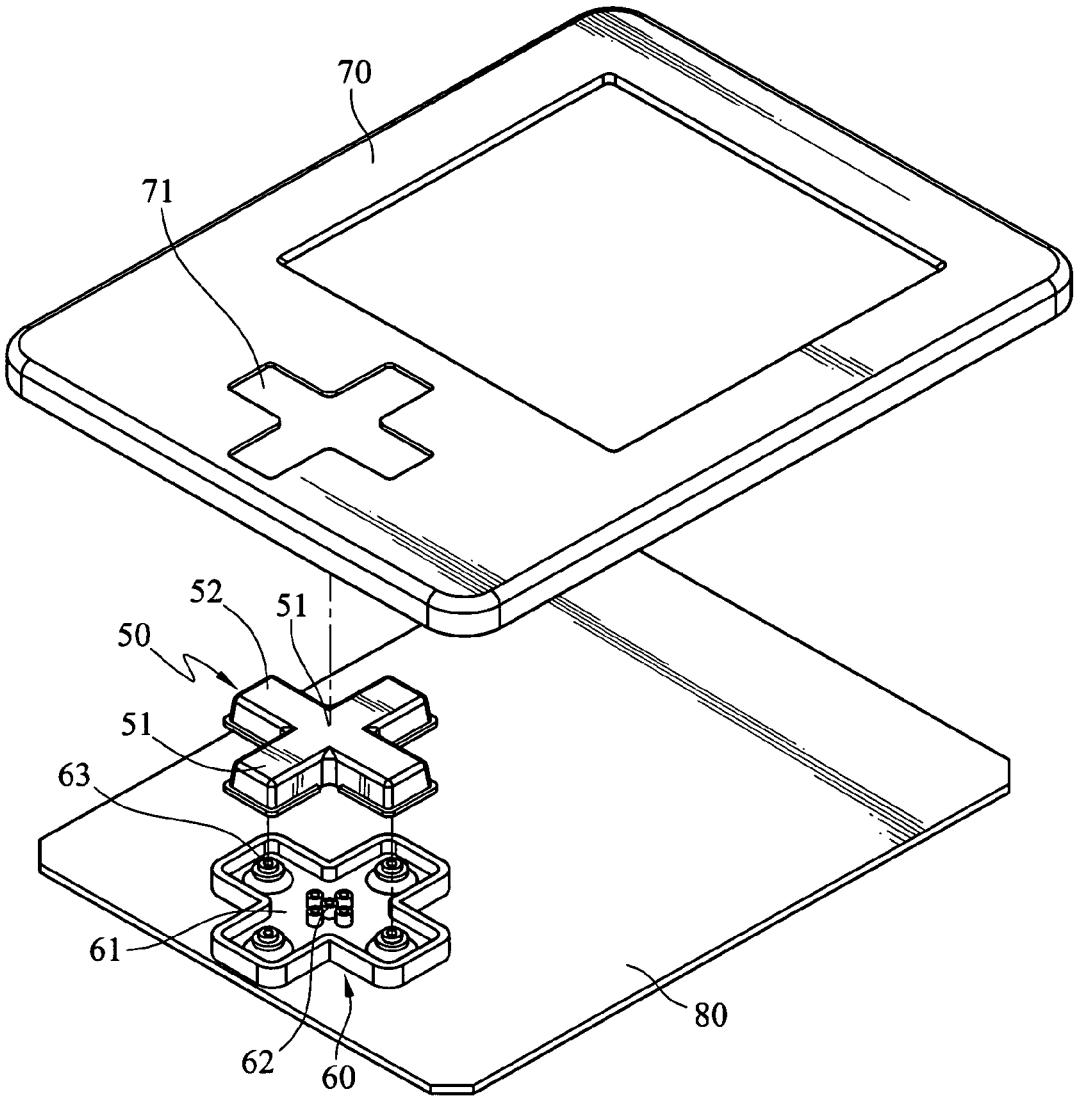
FIG. 6 is an exploded view of a second embodiment of the invention.

Refer to FIG. 6 for a second embodiment of the invention. It includes a button cap 50, a button seat 60, a case 70 and a base board 80.

The button cap 50 is a hollow box with an opening directing downwards. The button cap 10 has a base 51 and four extensions 52 extended respectively forwards, backwards, to the left and right from the base 51, a plurality of first button stems (not shown in the drawing) on the base 51 and four second button stems (not shown in the drawing) located respectively on the fours extensions 52. The button seat 60 has a top surface and a bottom surface. The top surface has an indented housing trough 61 directing upwards to mate with the button cap 50. The housing trough 61 has a plurality of first apertures 62 and second apertures 63 on the bottom to allow the button stems to pass through. The base board 80 holds the button seat 60 and has a plurality of switches (not shown in the drawing) to be depressed by the second button stems. The case 70 encases the base board 80 on the top and has a button port 71 to expose the button cap 50.

The second embodiment differs from the first embodiment by having four second button stems to switch different switches. The button cap may also adopt a simpler design by forming only one box containing one button stem to depress one switch.

The main feature of the invention is to use a button seat to isolate the button port area from the interior of the case to prevent water from seeping into the case. The button seat is hidden in the case without exposing the waterproof structure, as does the conventional design. Therefore wear and tear may be avoided. The button seat also provides an improved elastic returning effect to enable the button knob to return to its original position when external force is absent. Thus no elastic returning element is needed. The elements of the button knob structure are simplified, so element and assembly costs may be reduced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A button knob waterproofing design, comprising:

a button cap having at least one button stem extended downwards;

a button seat having a top surface and a bottom surface, the top surface having an indented housing trough for holding the button cap, the housing trough having at least one aperture on the bottom mating the button stem to allow the button stem to pass through and extend downwards to form a tight coupling with the button cap and the button seat;

a base board for holding the bottom surface of the button seat having at least one switch mating the button stem to receive depression of the button stem; and a case for encasing the base board having a button port to expose the button cap to receive the depression;

wherein the top surface of the button seat is in contact with an inner wall surface of the case closely, the housing trough having an opening directing upwards corresponding to the button port to expose the button cap.

2. The button knob waterproofing design of claim 1, wherein the button cap is a box having an opening directing downwards.

3. The button knob waterproofing design of claim 1, wherein the button cap has a flange extended horizontally from the bottom edge of an outer wall.

4. The button knob waterproofing design of claim 1, wherein the aperture has an extension extended axially upwards from the peripheral edge to extend the longitudinal length of the aperture to increase the contact area between the button stem and the aperture.

5. The button knob waterproofing design of claim 1, wherein the bottom surface of the button seat has an indented housing space facing downwards, the bottom of the housing trough forming an elastic membrane.

6. The button knob waterproofing design of claim 1, wherein the button seat is made from elastic material.

7. A button knob waterproofing design, comprising:

a button cap having at least one first button stem and at least one second button stem, the first button stem being longer than the second button stem;

a button seat having a top surface and a bottom surface, the top surface having an indented housing trough for holding the button cap, the housing trough having a first aperture and a second aperture on the bottom to allow respectively the first button stem and the second button stem to pass through and extend downwards to form a tight coupling with the button cap and the button seat;

a base board for holding the bottom surface of the button seat having at least one switch mating the second button stem to receive depression of the second button stem, the first button stem pressing the base board to form a fulcrum to allow the button cap to rock about the first button stem and drive the second button stem to move upwards and downwards; and a case for encasing the base board having a button port to expose the button cap to receive the depression;

wherein the top surface of the button seat is in contact with an inner wall surface of the case closely, the housing trough having an opening directing upwards corresponding to the button port to expose the button cap.

8. The button knob waterproofing design of claim 7, wherein the button cap is a rectangular box having an opening directing downwards.

9. The button knob waterproofing design of claim 8, wherein the button cap has two bosses on two long sides corresponding to each other, the case having two holding docks on an inner side abutting the button port mating the bosses of the button cap to make the first button stem in contact with the base board.

10. The button knob waterproofing design of claim 7, wherein the button cap has a flange extended horizontally from the bottom edge of an outer wall thereof.

11. The button knob waterproofing design of claim 7, wherein the apertures have an extension extended axially upwards from the peripheral edge to extend the longitudinal length of the apertures to increase the contact area between the button stems and the apertures.

12. The button knob waterproofing design of claim 7, wherein the bottom surface of the button seat has an indented housing space facing downwards, the bottom of the housing trough forming an elastic membrane.

13. The button knob waterproofing design of claim 12, wherein the membrane around the second aperture domes upwards substantially to increase space for deformation.

14. The button knob waterproofing design of claim 7, wherein the button seat is made from elastic material.

15. The button knob waterproofing design of claim 7, wherein the button cap has a first button stem and two second button stems, the first button stem being located between the two second button stems.

* * * * *